US005130216A

United States Patent [19]

Koyama et al.

[11] Patent Number: 5,130,216

[45] Date of Patent: Jul. 14, 1992

[54] PHOTOSENSITIVE MEMBER FOR ELECTROPHOTOGRAPHY

[75] Inventors: Takashi Koyama, Yokohama; Yuichi Hashimoto, Tokyo, both of Japan

[73] Assignee: Canon Kabushiki Kaisha, Tokyo, Japan

[21] Appl. No.: 408,991

[22] Filed: Sep. 18, 1989

[30] Foreign Application Priority Data

Sep. 22, 1988 [JP] Japan ..... 63-239445
Sep. 23, 1988 [JP] Japan ..... 63-238348

[51] Int. Cl.[5] ..... G03G 5/14

[52] U.S. Cl. ..... 430/59; 430/63; 430/65

[58] Field of Search ..... 430/64, 65, 62, 63, 430/59

[56] References Cited

U.S. PATENT DOCUMENTS 4,340,659 7/1982 Whalen-Shaw et al. ..... 430/65
4,882,257 11/1989 Maruyama et al. ..... 430/100
4,895,782 1/1990 Koyama et al. ..... 430/58

FOREIGN PATENT DOCUMENTS 48-030936 7/1973 Japan .
48-026141 9/1973 Japan .
49-010044 4/1974 Japan .
51-126149 10/1976 Japan .
52-020836 1/1977 Japan .
52-025638 2/1977 Japan .
52-100240 3/1977 Japan .
52-010138 5/1977 Japan .
53-048523 9/1978 Japan .
53-089435 11/1978 Japan .
54-026738 10/1979 Japan .
55-143564 3/1980 Japan .
55-103556 7/1980 Japan .
56-060448 4/1981 Japan .
46-047344 12/1981 Japan .
57-090639 10/1982 Japan .
58-106549 8/1983 Japan .
62-272279 5/1987 Japan .
62-270962 11/1987 Japan .

*Primary Examiner*—John Goodrow

[57] ABSTRACT

A photosensitive member for electrophotography comprising an electroconductive substrate, and an intermediate layer and a photosensitive layer disposed in this order on the substrate; the intermediate layer comprising a resin component and a salt; the intermediate layer containing the salt in an amount of 1-800 ppm based on the weight of the resin component.

12 Claims, 10 Drawing Sheets

PHOTOSENSITIVE MEMBER FOR ELECTROPHOTOGRAPHY

FIELD OF THE INVENTION AND RELATED ART

The present invention relates to a photosensitive member for electrophotography, particularly to a photosensitive member for electrophotography comprising a substrate and an intermediate layer disposed thereon which is capable of functioning as an adhesive layer and barrier layer.

Generally speaking, in a Carlson-type electrophotographic photosensitive member, stability in dark part potential and light part potential is important in order to form images without ground staining having a constant image density through the repetition of charging and exposure operations. From such a viewpoint, it has been proposed that a layer having a function of barrier layer is disposed between a photosensitive layer and a substrate.

Further, there has been proposed a photosensitive member having a laminate structure wherein the photosensitive layer is function-separated into a charge generation layer and a charge transport layer. In general, since the charge generation layer is disposed as a thin layer of, e.g., about 0.5 micron, a defect, staining, deposit or scratch on the surface of the substrate can cause irregularity or ununiformity in the thickness of the charge generation layer. When the thickness of the charge generation layer is not uniform, irregularity in sensitivity occurs in the photosensitive member. Accordingly, the charge generation layer is required to be as uniform as possible.

From the above-mentioned viewpoint, it has been proposed that an intermediate layer having a function of barrier layer and adhesive layer is disposed between a photosensitive layer and a substrate. Known examples of the layer to be disposed between the photosensitive layer and substrate include those of polyamide (Japanese Laid-Open Patent Application (KOKAI) Nos. 47344/1971 and 25638/1977), polyester (ditto, Nos. 20836/1977 and 26738/1979), polyurethane (ditto, Nos. 10044/1974, and 89435/1978), casein (ditto, No. 103556/1980), polypeptide (ditto, No. 48523/1978), polyvinyl alcohol (ditto, 100240/1977), polyvinyl pyrrolidone (ditto, No. 30936/1973), vinyl acetate-ethylene copolymer (ditto, No. 26141/1973), maleic acid anhydride ester polymer (ditto, No. 10138/1977), polyvinyl butyral (ditto, Nos. 90639/1982 and 106549/1983), quaternary ammonium salt-containing polymer (ditto, No. 126149/1976 and 60448/1981), and ethyl cellulose (ditto, No. 143564/1980).

However, in the conventional electro-photographic photosensitive member comprising an intermediate layer of the above-mentioned material, since the resistance of the intermediate layer changes depending on a change in temperature and/or humidity, it is difficult to constantly obtain stable potential characteristics and image quality under various environmental conditions ranging from a low temperature-low humidity condition to a high temperature-high humidity condition.

For example, when the conventional photosensitive member is repetitively used under a low temperature-low humidity condition under which the resistance of the intermediate layer is increased, charges are liable to remain in the intermediate layer, and the light part potential and residual potential are increased, whereby fog occurs in the resultant copied image. When such a photosensitive member is used in an electrophotographic printer utilizing reversal development, there occurs a problem such that the image density is decreased, or copied images having a constant image quality cannot be obtained.

In order to improve such a characteristic under a low temperature-low humidity condition, it has been proposed that a carboxylic acid salt or sulfonic acid salt, etc., is added to an intermediate layer in an amount of about 0.1–50 wt. parts per 100 wt. parts of a resin (Japanese Laid-Open Patent Application Nos. 270962/1987 and 272279/1987).

However, when the photosensitive member having an intermediate layer containing a salt in the above-mentioned manner is used under a high temperature-high humidity condition, the resistance of the intermediate layer is decreased and the barrier function thereof is deteriorated, whereby the injection of carriers from the substrate side is increased to decrease the dark part potential. As a result, the image density is decreased. When such a photosensitive member is used in an electrophotographic printer utilizing reversal development, fog is liable to occur in the resultant image.

Thus, there has been desired an electrophotographic photosensitive member capable of providing stable potential characteristics and stable image quality under all environmental conditions ranging from a low temperature-low humidity condition to a high temperature-high humidity condition.

SUMMARY OF THE INVENTION

An object of the present invention is to provide an electrophotographic photosensitive member capable of providing stable potential characteristics and stable image quality under all environmental conditions ranging from a low temperature-low humidity condition to a high temperature-high humidity condition.

Another object of the present invention is to provide an electrophotographic photosensitive member suitable for a high-speed copying machine or high-speed printer which repeats a process including charging and exposure steps in a rapid cycle.

According to the present invention, there is provided a photosensitive member for electrophotography comprising: an electroconductive substrate, and an intermediate layer and a photosensitive layer disposed in this order on the substrate; the intermediate layer comprising a resin component and a salt; the intermediate layer containing the salt in an amount of 1–800 ppm based on the weight of the resin component.

The present invention also provides a photosensitive member for electrophotography comprising: an electroconductive substrate, and an intermediate layer and a photosensitive layer disposed in this order on the substrate; the intermediate layer comprising a resin component and an additive which comprises at least one species selected from the group consisting of perchlorate, borofluoride, thiocyanate, nitrate and halide; the intermediate layer containing the additive in an amount of 1–2000 ppm based on the weight of the resin component.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
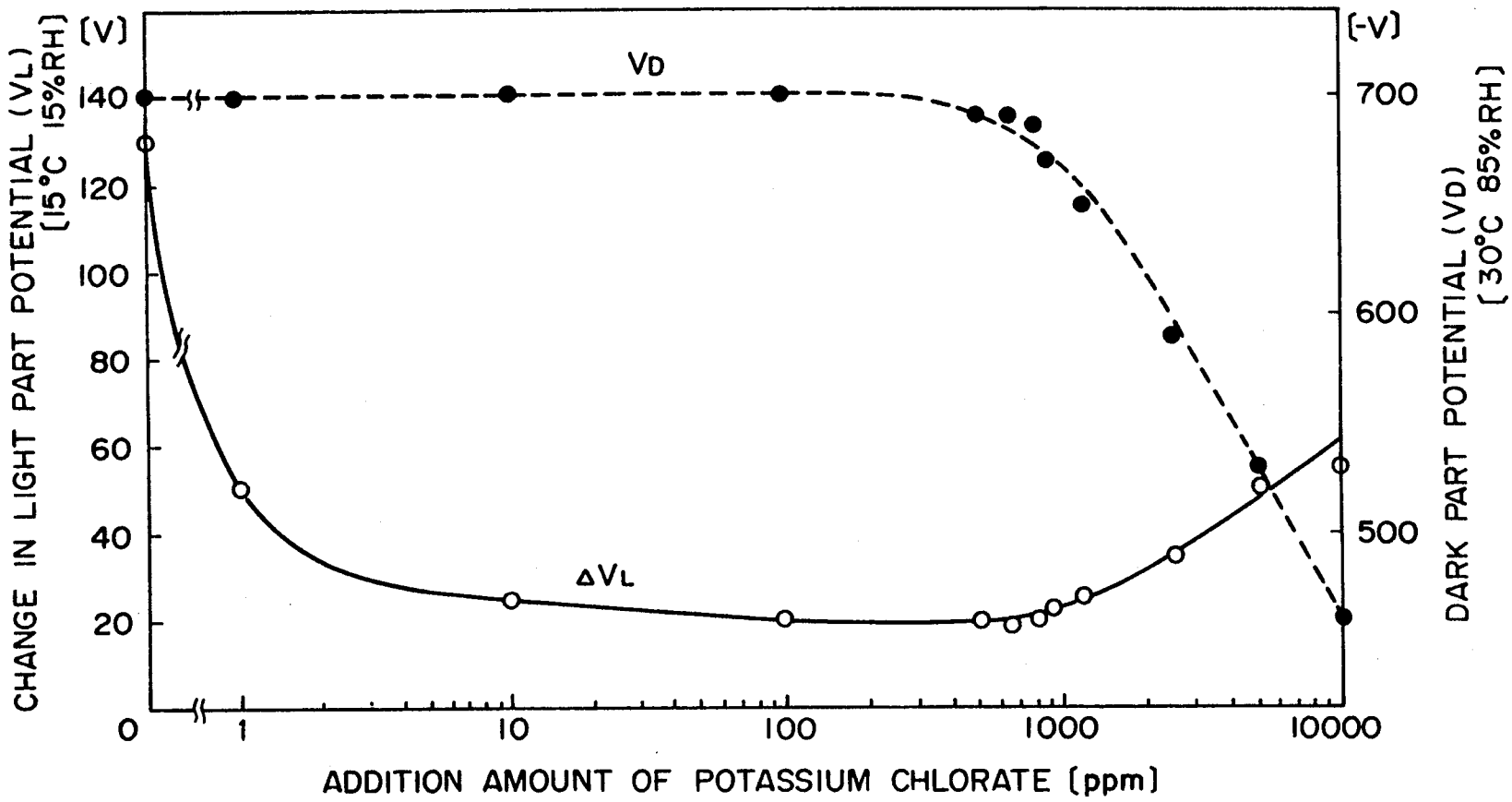
FIG. 1 is a graph showing a relationship between the addition amount of potassium chlorate and a change in light part potential ($\Delta V_L$) or dark part potential ($V_D$) with respect to Photosensitive Member Examples 1-12.

The electrophotographic photosensitive member according to the present invention comprises an electroconductive substrate, and an intermediate layer and a photosensitive member disposed in this order on the substrate. In the present invention, since the intermediate layer comprises a resin component and a small amount (1-800 ppm) of a salt as an additive, an increase in light part potential or residual potential may be prevented even when the photosensitive member is used repetitively under a low temperature-low humidity condition. Particularly, the photosensitive member according to the present invention provides substantially n increase in the light part potential or residual potential even when used under a severe condition such that a process including charging and exposure steps is repeated in a rapid cycle of 1 sec or shorter under a low temperature-low humidity condition. As a result, the photosensitive member according to the present invention is one suitable for a high-speed copying machine and a high-speed printer.

Incidentally, in the conventional photosensitive member including an intermediate layer, a large amount of salt is added to the intermediate layer to lower the resistance thereof in order to improve the increase in the light part potential and residual potential. However, while such a photosensitive member can improve the increase in the light part potential and residual potential under a low temperature-low humidity condition, the resistance of the intermediate layer is further lowered and the barrier function thereof becomes insufficient under a high temperature-high humidity condition. As a result, there occurs a serious problem such that the dark part potential is lowered due to deterioration in the charging ability or an increase in dark decay.

We have made various investigations repeatedly under a new conception such that the potential characteristic of a photosensitive member may be improved by enhancing the carrier injection property from a photosensitive layer to an intermediate layer without lowering the resistance of the intermediate layer. Such a conception is clearly different from the conventional conception such that the potential characteristic is improved by lowering the resistances of an intermediate layer. As a result, we have found that when a specific small amount of a salt is added to a resinous intermediate layer, the increase in the light part potential and residual potential is effectively improved without ill effect based on the reduction in the resistance of the intermediate layer.

The reason for the above-mentioned improvement in the potential characteristic based on the addition of the small amount of a salt is not necessarily clear but may be considered as follows.

The salt added is liable to have affinity to (or to be dissolved in) a solvent as compared with a resin. Accordingly, it is considered that when an intermediate layer is formed by coating and then dried, the salt is concentrated in the vicinity of the intermediate layer surface so as to provide a high concentration thereat, along with the migration of the salt to the intermediate layer surface based on the drying. As a result, the above-mentioned salt having a high concentration in the vicinity of the intermediate layer surface may enhance the carrier injection property from a photosensitive layer disposed thereon (e.g., by coating) at the interface therebetween.

In the present invention, a salt is added to the intermediate layer in an amount of 1-800 ppm, preferably 10-800 ppm, based on the weight of a resin component. A stable potential characteristic may constantly be obtained in the above-mentioned range even when the addition amount of the salt is changed in the range. The reason for this may be that the concentration of the salt in the vicinity of the intermediate layer surface is effectively promoted in the above-mentioned range of addition amount.

When the addition amount exceeds 800 ppm, the salt is distributed not only in the vicinity of the intermediate layer surface but also over the entirety (or bulk) of the intermediate layer, whereby the intermediate layer is caused to have a low resistance as in the conventional intermediate layer containing a large amount of a salt. Particularly, under a high temperature-high humidity condition, the resistance of the intermediate layer is further lowered, and the barrier property thereof becomes insufficient. As a result, under a high temperature-high humidity condition, such a photosensitive member causes a decrease in dark part potential, and the dark part potential is decreased due to deterioration in chargeability and an increase in dark decay. Further, such a photosensitive member shows a so-called "descent phenomenon" such that the potential is further decreased in repetitive use. Accordingly, when such a photosensitive member containing a large amount of a salt is used in a copying machine, it provides a low image density. When such a photosensitive member is used in a printer utilizing a reversal development system, fog and defects in the form of black spots appear in the resultant image, whereby the image quality is considerably deteriorated. Further, when a certain species of the salt is used, an excess of the salt can migrate from the intermediate layer to the photosensitive layer to lower the sensitivity of the photosensitive member.

On the other hand, the addition amount of a salt is smaller than 1 ppm, it produces little effect.

The "salt" used herein refers to a compound which is formed when the hydrogen of an acid is replaced by a metal or its equivalent (e.g., an inorganic or organic ammonium radical). In the present invention, an inorganic salt or/and an organic salt can be used, but the inorganic salt is preferred in view of the migrating property thereof to the surface of an intermediate layer.

The resin component to be used in the intermediate layer may be a known one, but may preferably be one or more species selected from: solvent-soluble (or alcohol-soluble) polyamides such as copolymer nylon and N-methoxy-methylated nylon; phenolic resin, polyurethane, polyurea, and polyester. Among these, alcohol-soluble polyamide and polyurethane are particularly preferred. It is considered that the salt effectively migrates to the surface of a coating film in the above-mentioned resin.

When the resin component of the intermediate layer is a water-soluble polymer such as polyacrylamide, water-soluble polyvinyl acetal, and sulfonated polystyrene resin, the effect of the addition of the salt is lessened. The reason for this may be considered that since the salt is well dissolved in the water-soluble polymer, the salt is uniformly distributed over the entirety of the intermediate layer, whereby the concentration on the surface thereof is less liable to occur.

Specific examples of the salt to be used in the intermediate layer may include: perchlorate; borofluoride; thiocyanate; nitrate such as nitric acid salt and nitrous acid salt; halide such as fluoride, chloride, bromide and iodide; carbonate; hydrogenecarbonate; thiocarbonate; tungstate; periodate; hexafluorophosphate; hexafluorosilicate; chlorate; hydroxide; etc. These salts may preferably be those comprising, as a cation, an ion of a metal such as lithium, sodium, potassium, magnesium, calcium and aluminum; ammonium ion; and an organic ion such as alkyl ammonium ion, alkylbenzylammonium ion and pyridinium ion. The above-mentioned salts may be used singly or as a mixture of two or more species.

Among these, perchlorate, borofluoride, thiocyanate, nitrate and halide are preferred. According to our investigation, these specific salts have a great migrating ability to the surface of an intermediate layer. Even when one of these specific salts is added to the intermediate layer in a larger amount than that of the other salts, it may improve the potential characteristic without lowering the resistance of the intermediate layer. The above-mentioned specific salts may produce a good effect in the range of 1–2000 ppm.

The intermediate layer according to the present invention comprises the above-mentioned resin and salt, but may further comprise another additive as desired. Specific examples of such an additive may include: a surfactant (preferably a nonionic surfactant), a silicone leveling agent, a silane coupling agent, a titanate coupling agent, etc.

In the present invention, the above-mentioned intermediate layer may for example be formed by dispersing or dissolving a resin component and a predetermined amount of a salt in an appropriate solvent, applying the resultant coating liquid onto an electroconductive substrate, and then drying the resultant coating layer.

In the present invention, the intermediate layer may preferably have a thickness of 0.1–10.0 microns, more preferably 0.5–5.0 microns. The intermediate layer may be formed on a substrate by dip coating, spray coating, roller coating, etc.

In the present invention, the photosensitive layer disposed on the intermediate layer may be a single layer-type or a laminate structure-type which is function-separated into a charge generation layer and a charge transport layer.

In the laminate structure-type photosensitive member, the charge generation layer may preferably comprise a charge-generating substance and a binder resin. Specific examples of the charge-generating substance may include: azo pigments such as Sudan Red and Dianil Blue; quinone pigments such as pyrenequinone and anthanthrone; quinocyanine pigments; perylene pigments, indigo pigments such as indigo and thioindigo; azulenium salt pigments; and phthalocyanine pigments such as copper phthalocyanine. Specific examples of the binder resin may include: polystyrene, polyvinyl acetate, acrylic resin, polyvinyl pyrrolidone, ethyl cellulose, and cellulose acetate butyrate.

In order to form a charge generation layer, above-mentioned charge-generating substance may be dispersed in a resin together with a solvent, and the resultant dispersion may be applied onto the above-mentioned intermediate layer. Such a charge generation layer may preferably have a thickness of 5 microns or below, more preferably 0.05–2 microns.

The laminate-type photosensitive member may preferably comprise a charge transport layer disposed on the charge generation layer. The charge transport layer may preferably comprise a charge-transporting substance. Specific examples of the charge-transporting substance may include: polycyclic aromatic compounds comprising, as a main chain or side chain, biphenylene, anthracene, pyrene, phenanthrene, etc.; nitrogen-containing cyclic compounds such as indole, carbazole, oxadiazole, and pyrazoline; hydrazone compounds; and styryl compounds.

In order to form a charge transport layer, charge-transporting substance may be dispersed or dissolved in a binder resin having a film-forming property, as desired, and the resultant dispersion may be applied onto the charge generation layer.

Specific examples of the resin having a film-forming property may include: polyester, polycarbonate, polymethacrylate, and polystyrene. The charge transport layer may preferably have a thickness of 5–40 microns, more preferably 10–30 microns.

In the present invention, the laminate structure-type photosensitive member may also comprise a charge transport layer and a charge generation layer disposed thereon.

Further, the photosensitive layer of the above-mentioned single layer-type photosensitive member may be prepared by incorporating the above-mentioned charge-generating substance and charge-transporting substance in a resin.

In the present invention, the photosensitive layer may also comprise: a layer of an organic photoconductive polymer such as polyvinyl carbazole and polyvinyl anthracene; a selenium deposition layer, selenium-tellurium deposition layer, and an amorphous silicon layer. Further, in the present invention, a protective layer may be disposed on the photosensitive layer as desired.

The electroconductive substrate used in the present invention may be any one as long a it has an electroconductivity. Specific examples of the substrate may include: a drum or sheet comprising a metal such as aluminum, copper, chromium, nickel, zinc, and stainless steel; a laminate comprising a plastic film and a film of a metal such as aluminum and copper; a plastic film having thereon a vapor-deposited layer comprising aluminum, indium oxide, tin oxide, etc.; and a sheet or film of metal, plastic, paper, etc., on which an electroconductive substance is applied singly, or together with an appropriate binder resin as desired, to form an electroconductive layer.

Specific examples of the electroconductive substance used in the electroconductive layer may include, powder, film or short fibers of a metal such as aluminum, copper, nickel and silver; electroconductive metal oxide such as antimony oxide, indium oxide and tin oxide; electroconductive polymer such as polypyrrole, polyaniline, and polyelectrolyte; carbon fiber, carbon black and graphite powder; organic and inorganic electrolyte; and electroconductive particles of which surfaces have been coated with these electroconductive substances.

Specific examples of the binder resin used in the electroconductive layer may include: thermoplastic resins such as polyamide, polyester, acrylic resin, polyamide acid ester, polyvinyl acetate, polycarbonate, polyvinyl formal, polyvinyl butyral, polyvinyl alkyl ether, polyalkylene ether, and polyurethane elastomer; and thermosetting resins such as thermosetting polyurethane, phenolic resin, and epoxy resin.

The mixing ratio between the electroconductive substance and the binder resin may preferably be about 5:1 to 1:5, while it may be determined in view of the resistivity, surface characteristic, coating suitability, etc., of the electroconductive layer.

When the electroconductive substance comprises powder, it may be subjected to a mixing operation by means of a ball mill, a roll mill, a sand mill, etc., in a general manner. The electroconductive layer may further comprise another additive as desired. Specific examples of such an additive may include: a surfactant, a silicone leveling agent, a silane coupling agent, a titanate coupling agent, etc.

The electrophotographic photosensitive member according to the present invention may be used not only in an electrophotographic copying machine but also in a laser printer, a CRT printer, an electrophotographic plate-making system, etc.

Hereinbelow, the present invention is described in more detail with reference to specific examples. In the following description, "parts" are parts by weight.

EXAMPLE 1

50 parts of titanium oxide powder coated with tin oxide containing 10% of antimony oxide, 25 parts of resol-type phenolic resin, and 0.002 part of a silicone oil (polydimethylsiloxane-polyoxyalkylene copolymer, average molecular weight: 3000) were dispersed in 20 parts of methyl cellosolve, and 5 parts of methanol by means of a sand mill using 1 mm-diameter glass beads for 2 hours to prepare a coating material for an electroconductive layer.

The thus prepared coating material was applied by dipping onto an aluminum cylinder having a diameter of 30 mm and a length of 260 mm, as a substrate, and then dried at 140° C. for 30 min. to form a 20 micron-thick electroconductive layer on the substrate.

Separately, 2 parts of a quaternary (6, 12, 66, 610) copolymer nylon resin (average molecular weight = 14,000) and 6 parts of N-methoxymethylated 6-nylon resin (average molecular weight = 11,000) were dissolved in 92 parts of methanol to prepare a coating material (stock solution) for an intermediate layer. Potassium chlorate as a salt was added to the thus prepared coating material in various amounts so that the resultant potassium chlorate contents were 1, 10, 100, 500, 650, 800, 900, 1200, 2500, 5000 and 10000 ppm, respectively, with respect to the weight of the resin component of the above-mentioned coating material, whereby coating liquids for intermediate layer for preparing Photosensitive Member Examples No. 1-11 were prepared. Further, the above-mentioned coating material for intermediate layer containing no salt was used as a coating liquid for preparing the intermediate layer of Photosensitive Member Example No. 12.

Each of the thus prepared coating liquid was applied onto the above-mentioned electroconductive layer by dipping and then dried at 100° C. for 20 min. to form thereon a 1.2 micron-thick intermediate layer.

Then, 3 parts of a disazo pigment represented by the following formula:

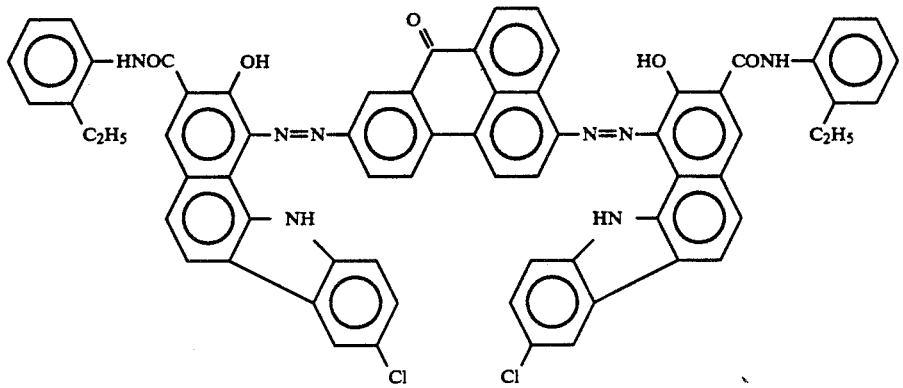

and 2 parts of polyvinyl benzal (benzal degree=80%, average molecular weight=11,000) were dispersed in 35 parts of cyclohexanone by means of a sand mill using 1 mm-diameter glass beads for 12 hours, and to the resultant dispersion, 60 parts of methyl ethyl ketone (MEK) was added to prepare a dispersion for a charge generation layer. The thus prepared dispersion was applied onto each of the above-mentioned intermediate layers by dipping and then dried at 80° C. for 20 min. to form thereon a 0.2 micron-thick charge generation layer.

Further, 10 parts of a styryl compound represented by the following formula:

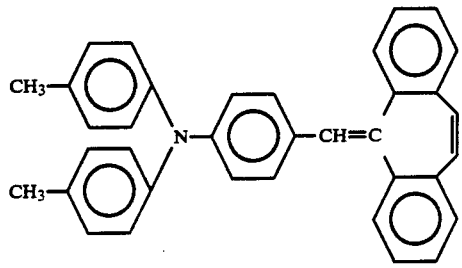

and 10 parts of a polycarbonate (average molecular weight=46,000) were dissolved in a mixture solvent comprising 40 parts of dichloromethane and 20 parts of monochlorobenzene. The resultant solution was applied onto each of the above-mentioned charge generation layers by dipping and then dried at 120° C. for 60 min. to form thereon a 25 micron-thick charge transport layer, whereby Photosensitive Member Examples No. 1 to 12 were prepared.

Each of the thus prepared Photosensitive Member Examples was assembled in a laser printer (a modification of Laser Printer LBP-SX, mfd. by Canon K.K.) utilizing reversal development, wherein a process including charging, laser exposure, development, transfer, and cleaning steps was repeated in a cycle of 0.8 sec. By using the laser printer, the electrophotographic characteristics of the Photosensitive Member Examples Nos. 1 to 12 were evaluated under a low temperature-low humidity (15° C., 15% RH) condition.

As a result, Photosensitive Member Examples 1 to 6 provided a sufficient potential contrast in the resultant images in the initial stage. Further, successive image formation of 1,000 sheets was conducted by using each of these Photosensitive Member Examples, good images were stably obtained without increasing the light part potential ($V_L$), as shown in FIG. 1.

On the other hand, Photosensitive Member Example No. 12 having an intermediate layer containing no salt provided an increase in the light part potential ($V_L$) as shown in FIG. 1 and showed a decrease in image density, when subjected to successive image formation of 1,000 sheets.

Further, image formation was conducted under a high temperature-high humidity (30° C., 85% RH) condition, Photosensitive Member Examples 1-6 having a salt content of 1-800 ppm in the intermediate layer provided a stable dark part potential ($V_D$) and provided good images as shown in FIG. 1.

On the other hand, with respect to Photosensitive Member Examples 7-11 having a salt content of above 800 ppm in the intermediate layer, the charging ability was deteriorated, the dark part potential ($V_D$) was lowered, and fog and image defects in the form of black spots appeared in the resultant image.

EXAMPLE 2

A coating material (stock solution) for an intermediate layer was prepared in the same manner as in Example 1. Lithium thiocyanate as a salt was added to the thus prepared coating material in various amounts so that the resultant lithium thiocyanate contents were 1, 10, 100, 500, 800, 1000, 1500, 2000, 2500, 3000, 6000 and 10000 ppm, respectively, with respect to the weight of the resin component of the above-mentioned coating material, whereby coating liquids for intermediate layer for preparing Photosensitive Member Examples No. 13-24 were prepared. Further, the above-mentioned coating material for intermediate layer containing no salt was used as a coating material for preparing the intermediate layer of Photosensitive Member Example No. 25.

Photosensitive Member Examples 13 to 25 were prepared in the same manner as in Example 1 except that the thus prepared coating liquids for intermediate layer were respectively used to form intermediate layers.

Each of the thus prepared Photosensitive Member Examples was assembled in a laser printer utilizing reversal development, wherein a process including charging, laser exposure, development, transfer, and cleaning steps was repeated in a cycle of 0.8 sec. By using the laser printer, the electrophotographic characteristics of the Photosensitive Member Example Nos. 13 to 25 were evaluated under a low temperature-low humidity (10° C., 15% RH) condition.

As a result, Photosensitive Member Examples 13 to 17 provided a sufficient potential contrast in the resultant images in the initial stage. Further, successive image formation of 1,000 sheets was conducted by using each of these Photosensitive Member Examples, good images were stably obtained without increasing the light part potential ($V_L$), as shown in FIG. 2.

Figure 2:
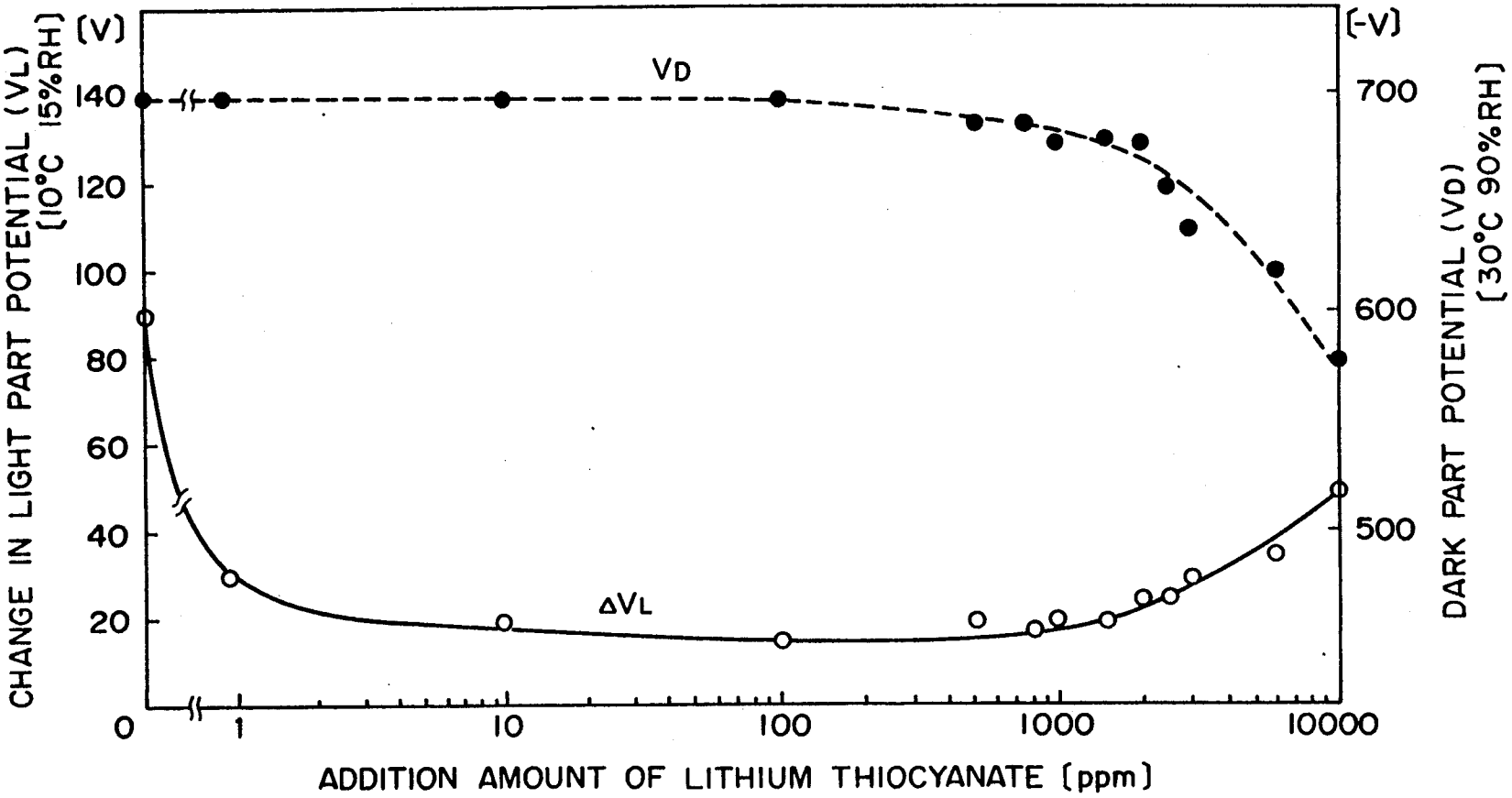
FIG. 2 is a graph showing a relationship between the addition amount of lithium thiocyanate and a change in light part potential ($\Delta V_L$ or dark part potential ($V_D$) with respect to Photosensitive Member Examples 13-25.

On the other hand, Photosensitive Member Example No. 25 having an intermediate layer containing no salt provided an increase in the light part potential ($V_L$) as shown in FIG. 2 and showed a decrease in image density, when subjected to successive image formation of 1,000 sheets.

Further, image formation was conducted under a high temperature-high humidity (30° C., 90% RH) condition, Photosensitive Member Examples having a salt content of 1-800 ppm in the intermediate layer provided a stable dark part potential ($V_D$) and provided good images as shown in FIG. 2.

On the other hand, with respect to Photosensitive Member Examples 18-24 having a salt content of above 2000 ppm in the intermediate layer, the charging ability was deteriorated, the dark part potential ($V_D$) was lowered, and fog and image defects in the form of black spots appeared in the resultant image.

EXAMPLE 3

A 20 micron-thick electroconductive layer was formed on an aluminum cylinder having a diameter of 30 mm and a length of 260 mm, as a substrate, in the same manner as in Example 2.

Separately, 1 part of hexamethylene diisocyanate, 13 parts of poly(oxypropylene)glycol (hydroxyl value=25 mg KOH/g), 6 parts of copoly(oxypropylene)(oxyethylene)triol (hydroxyl value=51 mg KOH/g), and 0.001 part of dibutyltin laurate were dissolved in 80 parts of MEK to prepare a coating material (stock solution) for an intermediate layer. Lithium carbonate as a salt was added to the thus prepared coating material in various amounts so that the resultant lithium carbonate contents were 1, 10, 100, 500, 650, 800, 900, 1200, 2500, 5000 and 10000 ppm, respectively, with respect to the weight of the solid content of the above-mentioned coating material, whereby coating liquids for intermediate layer for preparing Photosensitive Member Examples No. 26–36 were prepared. Further, the above-mentioned coating material for intermediate layer containing no salt was used as a coating liquid for preparing the intermediate layer of Photosensitive Member Example No. 37.

Each of the thus prepared coating liquids was applied onto the above-mentioned electroconductive layer by dipping and then dried and hardened at 140° C. for 60 min. to form thereon a 1.5 micron-thick intermediate layer comprising a polyurethane.

On each of the thus prepared intermediate layers, a charge generation layer and a charge transport layer were successively formed in the same manner as in Example 1, whereby Photosensitive Member Examples No. 26–37 were prepared.

Each of the thus prepared Photosensitive Member Examples was assembled in a laser printer utilizing reversal development, wherein a process including charging, laser exposure, development, transfer, and cleaning steps was repeated in a cycle of 0.7 sec. By using the laser printer, the electrophotographic characteristics of the Photosensitive Member Example Nos. 26 to 37 were evaluated under a low temperature-low humidity (15° C., 15% RH) condition.

As a result, Photosensitive Member Examples 26 to 31 provided a sufficient potential contrast in the resultant images in the initial stage. Further, successive image formation of 1,000 sheets was conducted by using each of these Photosensitive Member Examples, good images were stably obtained without increasing the light part potential ($V_L$) as shown in FIG. 3.

On the other hand, Photosensitive Member Example No. 37 having an intermediate layer containing no salt provided an increase in the light part potential ($V_L$) and showed a decrease in image density, when subjected to successive image formation of 1,000 sheets.

Figure 3:
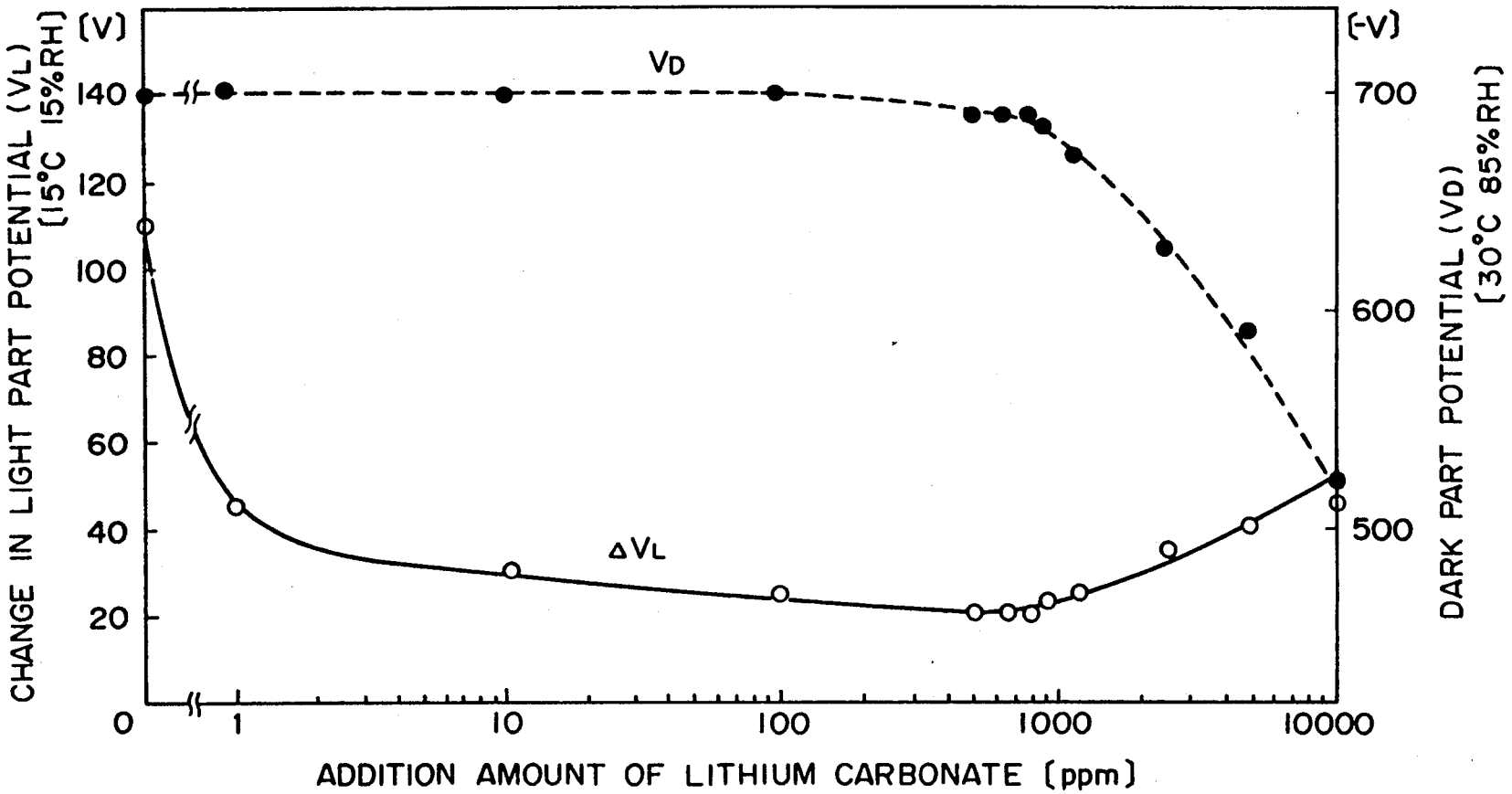
FIG. 3 is a graph showing a relationship between the addition amount of lithium carbonate and a change in light part potential ($\Delta V_L$ or dark part potential ($V_D$) with respect to Photosensitive Member Examples 26-37.

Further, image formation was conducted under a high temperature-high humidity (30° C., 85% RH) condition, Photosensitive Member Examples 26–31 having a salt content of 1–800 ppm in the intermediate layer provided a stable dark part potential ($V_D$) and provided good images as shown in FIG. 3.

On the other hand, with respect to Photosensitive Member Examples 32–36 having a salt content of above 800 ppm in the intermediate layer, the charging ability was deteriorated, the dark part potential ($V_D$) was lowered, and fog and image defects in the form of black spots appeared in the resultant image.

EXAMPLE 4

A coating material (stock solution) for an intermediate layer was prepared in the same manner as in Example 3. Lithium iodide as a salt was added to the thus prepared coating material in various amounts so that the resultant lithium iodide contents were 1, 10, 100, 500, 800, 1000, 1500, 2000, 2500, 3000, 6000 and 10000 ppm, respectively, with respect to the weight of the resin component of the above-mentioned coating material, whereby coating liquids for intermediate layer for preparing Photosensitive Member Examples No. 38–49 were prepared. Further, the above-mentioned coating material for intermediate layer containing no salt was used as a coating material for preparing the intermediate layer of Photosensitive Member Example No. 50.

Photosensitive Member Examples 38 to 50 were prepared in the same manner as in Example 3 except that the thus prepared coating liquids for intermediate layer were respectively used to form intermediate layers.

Each of the thus prepared Photosensitive Member Examples was assembled in a laser printer utilizing reversal development, wherein a process including charging, laser exposure, development, transfer, and cleaning steps was repeated in a cycle of 0.7 sec. By using the laser printer, the electrophotographic characteristics of the Photosensitive Member Example Nos. 38 to 50 were evaluated under a low temperature-low humidity (10° C., 15% RH) condition.

As a result, Photosensitive Member Examples 38 to 42 provided a sufficient potential contrast in the resultant images in the initial stage. Further, successive image formation of 1,000 sheets was conducted by using each of these Photosensitive Member Examples, good images were stably obtained without increasing the light part potential ($V_L$) as shown in FIG. 4.

On the other hand, Photosensitive Member Example No. 50 having an intermediate layer containing no salt provided an increase in the light part potential ($V_L$) and showed a decrease in image density, when subjected to successive image formation of 1,000 sheets.

Figure 4:
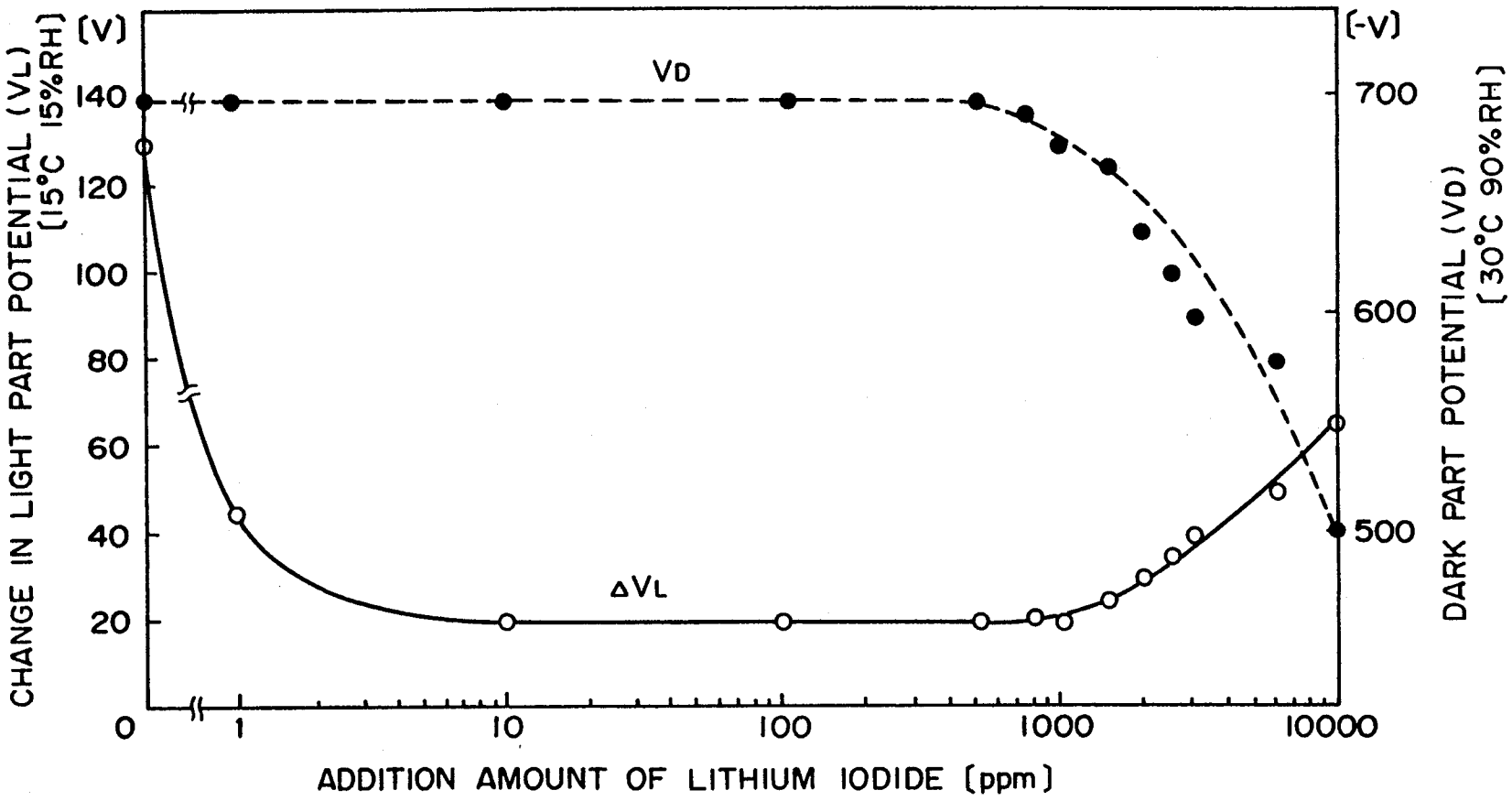
FIG. 4 is a graph showing a relationship between the addition amount of lithium iodide and a change in light part potential ($\Delta V_L$) or dark part potential ($V_D$) with respect to Photosensitive Member Examples 38-50.

Further, image formation was conducted under a high temperature-high humidity (30° C., 90% RH) condition, Photosensitive Member Examples 38–42 having a salt content of 1–800 ppm in the intermediate layer provided a stable dark part potential ($V_D$) and provided good images as shown in FIG. 4.

On the other hand, with respect to Photosensitive Member Examples 43–49 having a salt content of above 800 ppm (further, above 2000 ppm) in the intermediate layer, the charging ability was deteriorated, the dark part potential ($V_D$) was lowered, and fog and image defects in the form of black spots appeared in the resultant image.

EXAMPLE 5

A 20 micron-thick electroconductive layer was formed on an aluminum cylinder having a diameter of 30 mm and a length of 360 mm, as a substrate, in the same manner as in Example 4.

Separately, 4 parts of a copolymer nylon resin (average molecular weight=14,000) and 4 parts of N-methoxymethylated 6-nylon resin (average molecular weight=11,000) were dissolved in 92 parts of methanol to prepare a coating material (stock solution) for an intermediate layer. Sodium periodate as a salt was added to the thus prepared coating material in various amounts so that the resultant sodium periodate contents were 1, 10, 100, 500, 650, 800, 900, 1200, 2500, 5000 and 100000 ppm, respectively, with respect to the weight of the resin component of the above-mentioned coating material, whereby coating liquids for intermediate layer for preparing Photosensitive Member Examples No. 51–61 were prepared. Further, the above-mentioned coating material for intermediate layer containing no salt was used as a coating liquid for preparing the intermediate layer of Photosensitive Member Example No. 62.

Each of the thus prepared coating liquids was applied onto the above-mentioned electroconductive layer by dipping and then dried at 80° C. for 30 min. to form thereon a 1.0 micron-thick intermediate layer.

Then, 4 parts of a disazo pigment represented by the following formula:

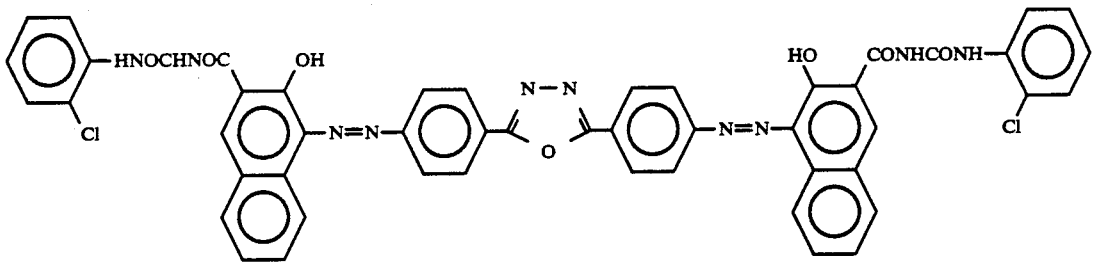

and 2 parts of polyvinyl butyral (butyral degree=71%, average molecular weight=24,000) were dispersed in 34 parts of cyclohexanone by means of a sand mill using 1 mm-diameter glass beads for 20 hours, and to the resultant dispersion, 60 parts of tetrahydrofuran (THF) was added to prepare a dispersion for a charge generation layer. The thus prepared dispersion was applied onto each of the above-mentioned intermediate layers by dipping and then dried at 80° C. for 15 min. to form thereon a 0.18 micron-thick charge generation layer.

Further, 10 parts of the styryl compound used in example 1, and 10 parts of a polycarbonate (average molecular weight=33,000) were dissolved in a mixture solvent comprising 40 parts of dichloromethane and 20 parts of monochlorobenzene. The resultant solution was applied onto each of the above-mentioned charge generation layers by dipping and then dried at 120° C. for 60 min. to form thereon a 25 micron-thick charge transport layer, whereby Photosensitive Member Example Nos. 51 to 62 were prepared.

Each of the thus prepared Photosensitive Member Examples was assembled in a copying machine (a modification of a Copying Machine NP-4835, mfd. by Canon K.K.) wherein a process including charging, halogen exposure, development, transfer, and cleaning steps was repeated in a cycle of 0.6 sec. By using the copying machine, the electrophotographic characteristics of the Photosensitive Member Examples Nos. 51 to 62 were evaluated under a low temperature-low humidity (15° C., 15% RH) condition.

As a result, Photosensitive Member Examples 51 to 56 provided a sufficient potential contrast in the resultant images in the initial stage. Further, successive image formation of 1,000 sheets was conducted by using each of these Photosensitive Member Examples, good images were stably obtained with substantially no increase in the light part potential ($V_L$), as shown in FIG. 5.

Figure 5:
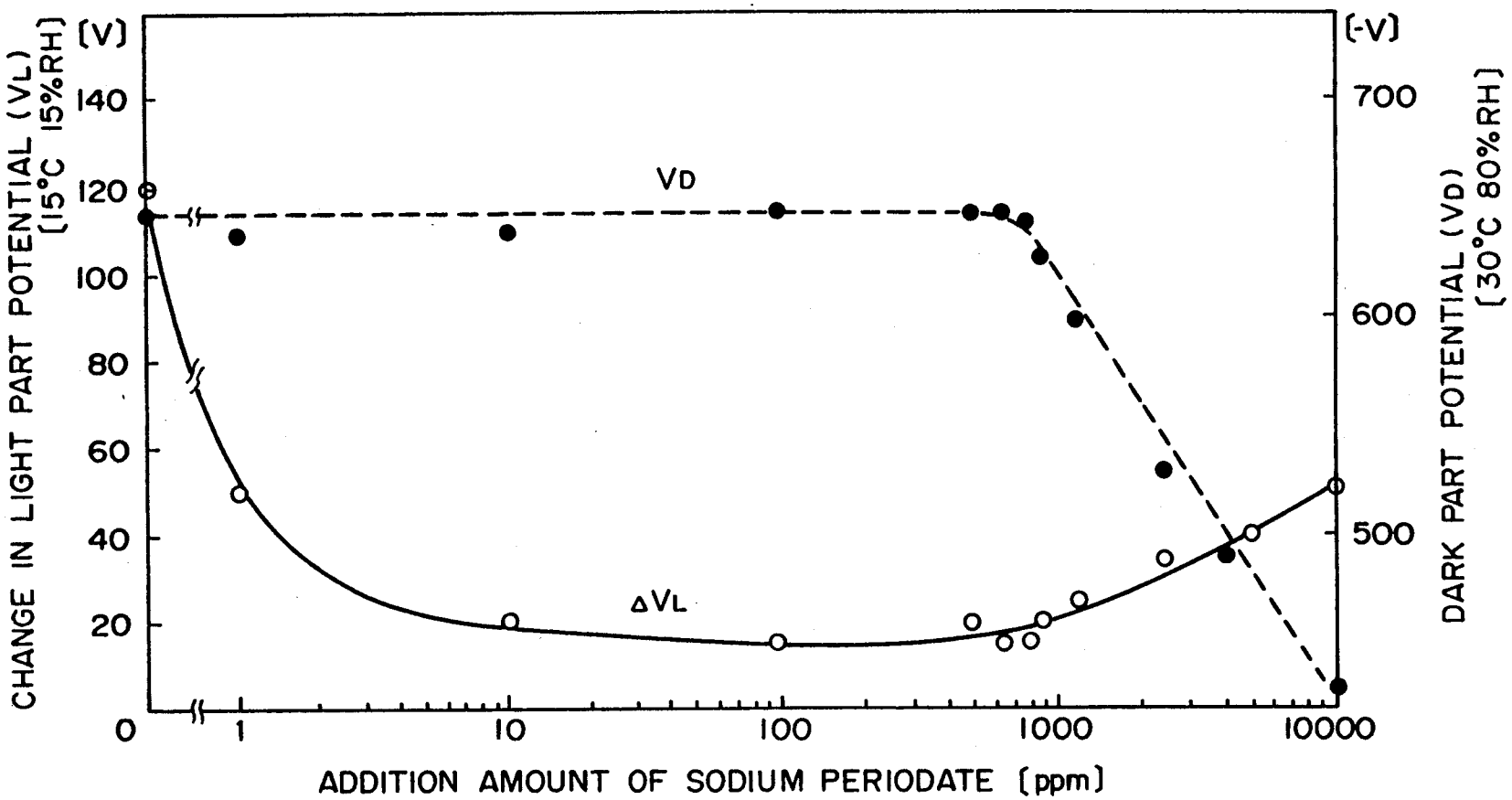
FIG. 5 is a graph showing a relationship between the addition amount of sodium periodate and a change in light part potential ($\Delta V_L$) or dark part potential ($V_D$) with respect to Photosensitive Member Examples 51-62.

On the other hand, Photosensitive Member Example No. 62 having an intermediate layer containing no salt provided an increase in the light part potential ($V_L$), as shown in FIG. 5 and provided fog in the resultant image, when subjected to successive image formation of 1,000 sheets.

Further, image formation was conducted under a high temperature-high humidity (30° C., 85% RH) condition, Photosensitive Member Examples 51-56 having a salt content of 1-800 ppm in the intermediate layer provided a stable dark part potential ($V_D$) and provided good images as shown in FIG. 5.

On the other hand, with respect to Photosensitive Member Examples 57-61 having a salt content of above 800 ppm in the intermediate layer, the charging ability was deteriorated, and the dark part potential ($V_D$) and image density were lowered.

EXAMPLE 6

A coating material (stock solution) for an intermediate layer was prepared in the same manner as in Example 5. Sodium perchlorate as a salt was added to the thus prepared coating material in various amounts so that the resultant sodium perchlorate contents were 1, 10, 100, 500, 800, 1000, 1500, 2000, 2500, 3000, 6000 and 10000 ppm, respectively, with respect to the weight of the resin component of the above-mentioned coating material, whereby coating liquids for intermediate layer for preparing Photosensitive Member Examples No. 63-74 were prepared. Further, the above-mentioned coating material for intermediate layer containing no salt was used as a coating material for preparing the intermediate layer of Photosensitive Member Example No. 75.

Photosensitive Member Examples 63 to 75 were prepared in the same manner as in Example 5 except that the thus prepared coating liquids for intermediate layer were respectively used to form intermediate layers.

Each of the thus prepared Photosensitive Member Examples was assembled in a copying machine wherein a process including charging, halogen exposure, development, transfer, and cleaning steps was repeated in a cycle of 0.6 sec. By using the copying machine, the electrophotographic characteristics of the Photosensitive Member Example Nos. 63 to 75 were evaluated under a low temperature-low humidity (10° C., 15% RH) condition.

As a result, Photosensitive Member Examples 63 to 67 provided a sufficient potential contrast in the resultant images in the initial stage. Further, successive image formation of 1,000 sheets was conducted by using each of these Photosensitive Member Examples, good images were stably obtained substantially without increasing the light part potential ($V_L$) as shown in FIG. 6.

Figure 6:
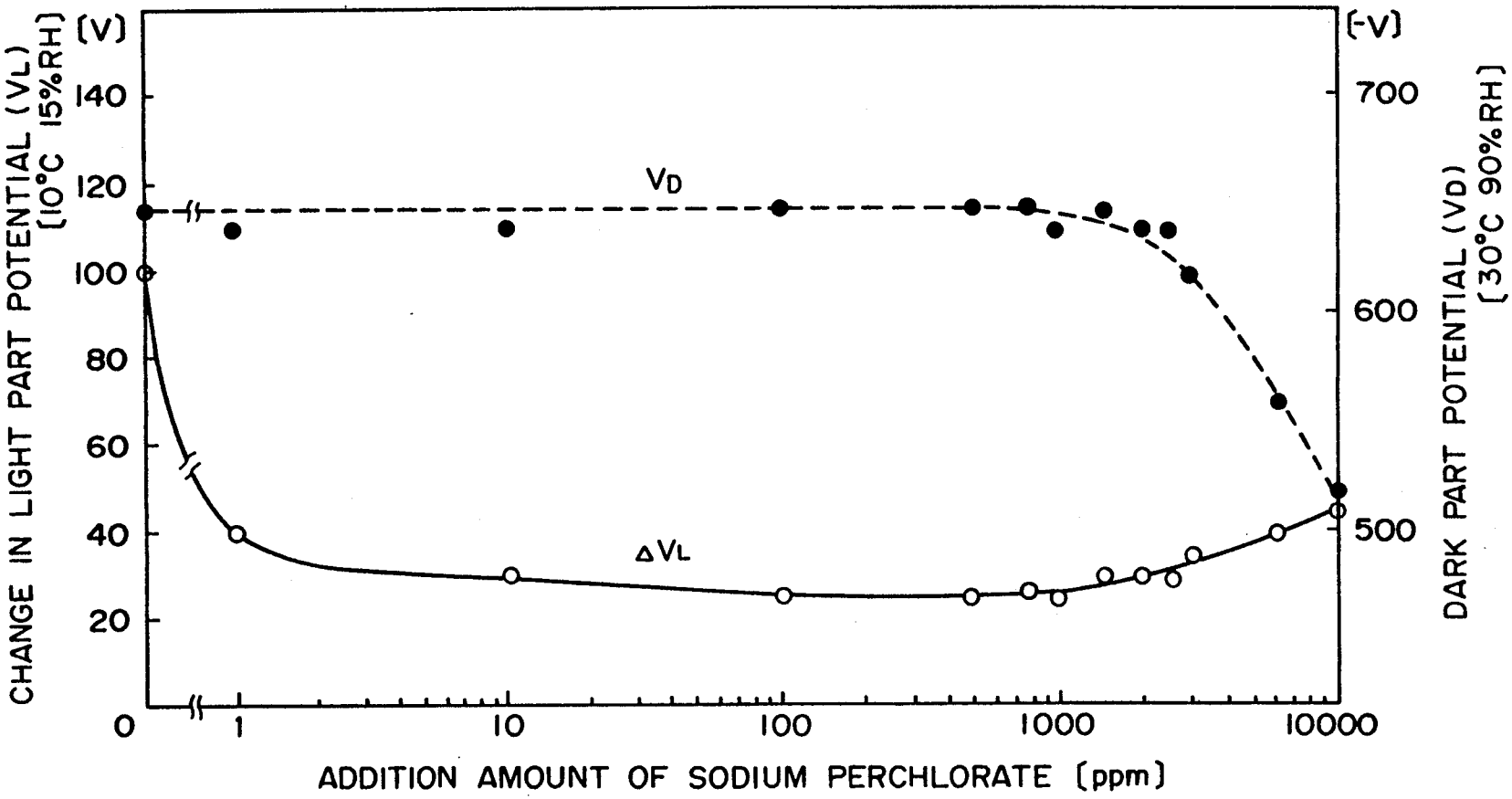
FIG. 6 is a graph showing a relationship between the addition amount of sodium perchlorate and a change in light part potential ($\Delta V_L$) or dark part potential ($V_D$) with respect to Photosensitive Member Examples 63-75.

On the other hand, Photosensitive Member Example No. 75 having an intermediate layer containing no salt provided an increase in the light part potential ($V_L$) as shown in FIG. 6 and provided fog in the resultant image, when subjected to successive image formation of 1,000 sheets.

Further, image formation was conducted under a high temperature-high humidity (30° C., 90% RH) condition, Photosensitive Member Examples 63-67 having a salt content of 1-800 ppm in the intermediate layer provided a stable dark part potential ($V_D$) and provided good images as shown in FIG. 6.

On the other hand, with respect to Photosensitive Member Examples 68–74 having a salt content of above 800 ppm (further, above 2000 ppm) in the intermediate layer, the charging ability was deteriorated, and the dark part potential ($V_D$) and image density were lowered.

EXAMPLE 7

12 parts of a copolymer nylon resin (average molecular weight = 9,000) and 8 parts of N-methoxymethylated 6-nylon resin (average molecular weight = 12,000) were dissolved in 90 parts of methanol to prepare a polyamide coating material (stock solution A) for an intermediate layer.

To the thus prepared coating material (A), each of salts including calcium hydroxide, lithium hydrogencarbonate, sodium chlorate, calcium carbonate, and stearyl-trimethylammonium carbonate was added so that the resultant salt content was 100 ppm with respect to the weight of the resin component of the above-mentioned coating material (A), whereby coating liquids for intermediate layer for preparing Photosensitive Member Examples No. 76–80 were prepared. Further, the above-mentioned coating material (A) for intermediate layer containing no salt was used as a coating liquid for preparing the intermediate layer of Photosensitive Member Example No. 81.

Separately, 5 parts of blocked (or masked) isocyanate compound predominantly comprising hexamethylene diisocyanate (effective -NCO: 11.6 %), 10 parts of poly(oxypropylene)(oxyethylene)glycol (hydroxyl value = 33 mg KOH/g), 6 parts of copoly(oxypropylene)triol (hydroxyl value = 47 mg KOH/g), and 0.001 part of dibutyltin laurate were dissolved in 79 parts of MEK to prepare a polyurethane coating material (stock solution (B)) for an intermediate layer. To the thus prepared coating material (B), each of the salts including sodium hexafluorophosphate, aluminum periodate, potassium thiocarbonate, magnesium tungstate, and lithium hexafluorosilicate was added so that the resultant salt content was 50 ppm with respect to the weight of the solid content of the above-mentioned coating material (B), whereby coating liquids for intermediate layer for preparing Photosensitive Member Example Nos. 82–86 were prepared. Further, the above-mentioned coating material (B) for intermediate layer containing no salt was used as a coating liquid for preparing the intermediate layer of Photosensitive Member Example No. 87.

Separately, 20 parts of a resol-type phenolic resin, and 2 parts of a polyvinyl butyral (butyral degree = 67 %, average molecular weight = 28,000) were dissolved in 78 parts of methanol to prepare a phenolic resin coating material (stock solution (C)) for an intermediate layer. To the thus prepared coating material (C), each of the salts including lithium chlorate, sodium periodate, calcium hydrogencarbonate, calcium hexafluorosilicate and aluminum carbonate was added so that the resultant salt content was 100 ppm with respect to the weight of the solid content of the above-mentioned coating material (C), whereby coating liquids for intermediate layer for preparing Photosensitive Member Examples No. 88–92 were prepared. Further, the above-mentioned coating material (C) for intermediate layer containing no salt was used as a coating liquid for preparing the intermediate layer of Photosensitive Member Example No. 93.

Each of the thus prepared coating liquids for intermediate layer was applied onto a 50 micron-thick aluminum sheet by means of a wire bar coater and then dried to form thereon a 1.4 micron-thick intermediate layer. The drying conditions used herein were 100° C., 20 min. for the polyamide intermediate layer; 150° C., 180 min. for polyurethane intermediate layer; and 140° C., 30 min. for the phenolic resin intermediate layer.

Then, 3 parts of a disazo pigment represented by the following formula:

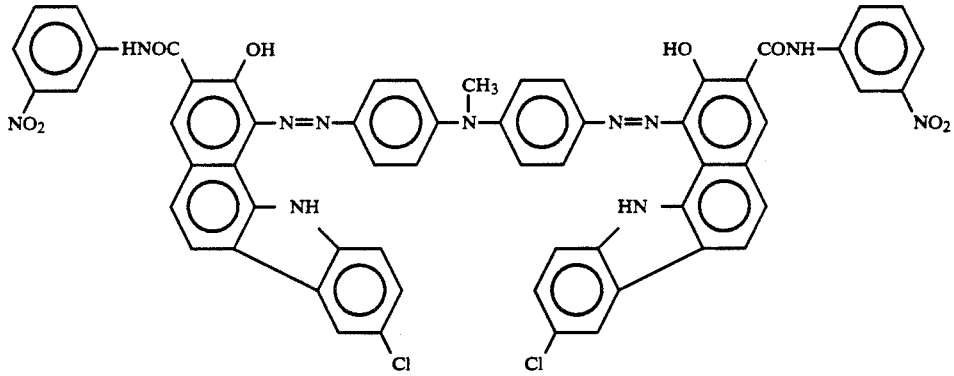

and 2 parts of polymethyl methacrylate (average molecular weight = 16,000) were dispersed in 35 parts of cyclohexanone by means of a sand mill using 1 mm-diameter glass beads for 30 hours, and to the resultant dispersion, 60 parts of methyl ethyl ketone (MEK) was added to prepare a dispersion for a charge generation layer. The thus prepared dispersion was applied onto each of the above-mentioned intermediate layers by means of a wire bar coater and then dried at 80° C. for 20 min. to form thereon a 0.25 micron-thick charge generation layer.

Further, 12 parts of a hydrazone compound represented by the following formula:

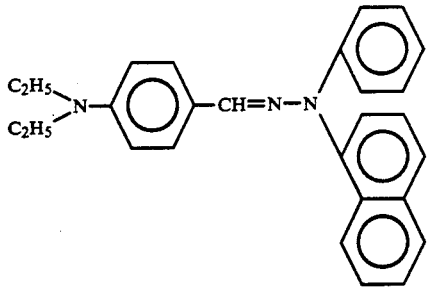

and 10 parts of a polycarbonate (average molecular weight=46,000) were dissolved in a mixture solvent comprising 40 parts of dichloromethane and 20 parts of monochlorobenzene. The resultant solution was applied onto each of the above-mentioned charge generation layers by means of a wire bar coater and then dried at 120° C. for 60 min. to form thereon a 20 micron-thick charge transport layer, whereby Photosensitive Member Example Nos. 76 to 93 were prepared.

With respect to each of the thus prepared Photosensitive Member Examples, a dark part potential characteristic and a light part potential characteristic were evaluated under a low temperature-low humidity (15° C., 15% RH) condition by means of a commercially available electrostatic charging tester (Model: EPA-8100, mfd. by Kawaguchi Denki Seisakusho).

More specifically, the photosensitive member was charged by using corona discharge of −6 KV, and then exposed to halogen light exposure so that light quantity at the photosensitive member surface was 1.8 lux.sec. Such a process including charging and exposure steps was repeated 1000 times. Before and after such repetitive charging and exposure operations, the surface potential ($V_D$) of the photosensitive member immediately after the charging, and the surface potential ($V_L$ after the exposure of 1.8 lux.sec were respectively measured. The cycle time required for the charging and exposure was 0.75 sec per one revolution.

The results are shown in the following Tables 1 to 3.

TABLE 1

| Photosensitive member | Intermediate layer | Salt added | Initial Stage $V_D(-V)$ | Initial Stage $V_L(-V)$ | After 1000 revolutions $V_D(-V)$ | After 1000 revolutions $V_L(-V)$ | Potential change $\Delta V_D$ | Potential change $\Delta V_L$ |
|---|---|---|---|---|---|---|---|---|
| Example 76 | Polyamide | $Ca(OH)_2$ | 695 | 139 | 695 | 169 | 0 | 30 |
| 77 | | $LiHCO_3$ | 700 | 140 | 705 | 180 | 5 | 40 |
| 78 | | $NaClO_3$ | 695 | 135 | 695 | 170 | 0 | 35 |
| 79 | | $CaCO_3$ | 680 | 130 | 690 | 175 | 10 | 45 |
| 80 | | Stearyl-trimethylammonium carbonate | 690 | 140 | 700 | 190 | 10 | 50 |
| Comp. Example 81 | | None | 705 | 130 | 760 | 255 | 60 | 125 |

TABLE 2

| Photosensitive member | Intermediate layer | Salt added | Initial Stage $V_D(-V)$ | Initial Stage $V_L(-V)$ | After 1000 revolutions $V_D(-V)$ | After 1000 revolutions $V_L(-V)$ | Potential change $\Delta V_D$ | Potential change $\Delta V_L$ |
|---|---|---|---|---|---|---|---|---|
| Example 82 | Polyurethane | $NaPF_6$ | 690 | 120 | 705 | 175 | 15 | 55 |
| 83 | | $Al(IO_4)_3$ | 705 | 110 | 715 | 160 | 10 | 50 |
| 84 | | $K_2CS_3$ | 690 | 125 | 710 | 185 | 20 | 60 |
| 85 | | $MgWO_4$ | 700 | 115 | 720 | 180 | 20 | 65 |
| 86 | | $LiPF_6$ | 695 | 100 | 710 | 150 | 15 | 50 |
| Comp. Example 87 | | None | 700 | 110 | 800 | 310 | 100 | 180 |

TABLE 3

| Photosensitive member | Intermediate layer | Salt added | Initial Stage $V_D(-V)$ | Initial Stage $V_L(-V)$ | After 1000 revolutions $V_D(-V)$ | After 1000 revolutions $V_L(-V)$ | Potential change $\Delta V_D$ | Potential change $\Delta V_L$ |
|---|---|---|---|---|---|---|---|---|
| Example 88 | Phenolic resin | $LiClO_3$ | 705 | 140 | 735 | 205 | 30 | 65 |
| 89 | | $NaIO_4$ | 690 | 125 | 710 | 170 | 20 | 45 |
| 90 | | $KHCO_3$ | 710 | 145 | 740 | 205 | 30 | 60 |
| 91 | | $CaSiF_5$ | 700 | 150 | 725 | 205 | 25 | 55 |
| 92 | | $Al_2(CO_3)_3$ | 695 | 130 | 720 | 180 | 25 | 50 |
| Comp. Example 93 | | None | 695 | 150 | 825 | 375 | 130 | 225 |

As apparent from the results shown in the above Tables 1-3, the repetition characteristic of a photosensitive member under a low temperature-low humidity condition is remarkably improved by incorporating a specific amount of a salt according to the present invention in the intermediate layer thereof.

Further, with respect to Photosensitive Member Example Nos. 76, 82, and 81, 87, the above-mentioned charging and exposure were successively repeated 1000 times by using the above-mentioned device while the cycle time was changed to 0.5, 0.75, 1.0, 1.5, 2.0 and 3.0 sec per revolution, whereby the change in the surface potential ($V_L$) after the exposure was measured.

Figure 7:
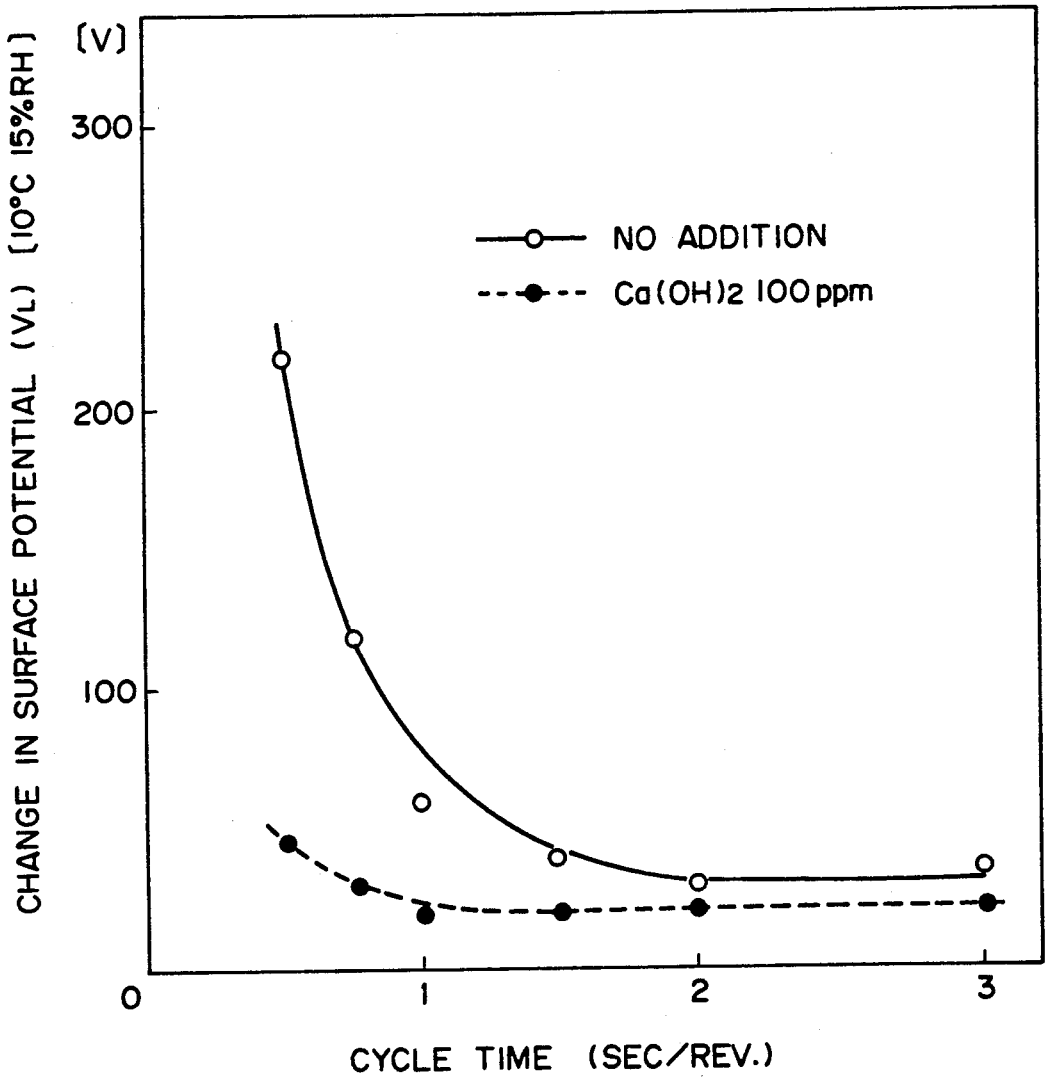
FIG. 7 is a graph showing a relationship between cycle time and surface potential ($\Delta V_L$) with respect to Photosensitive Member Examples 81 and 87.
Figure 8:
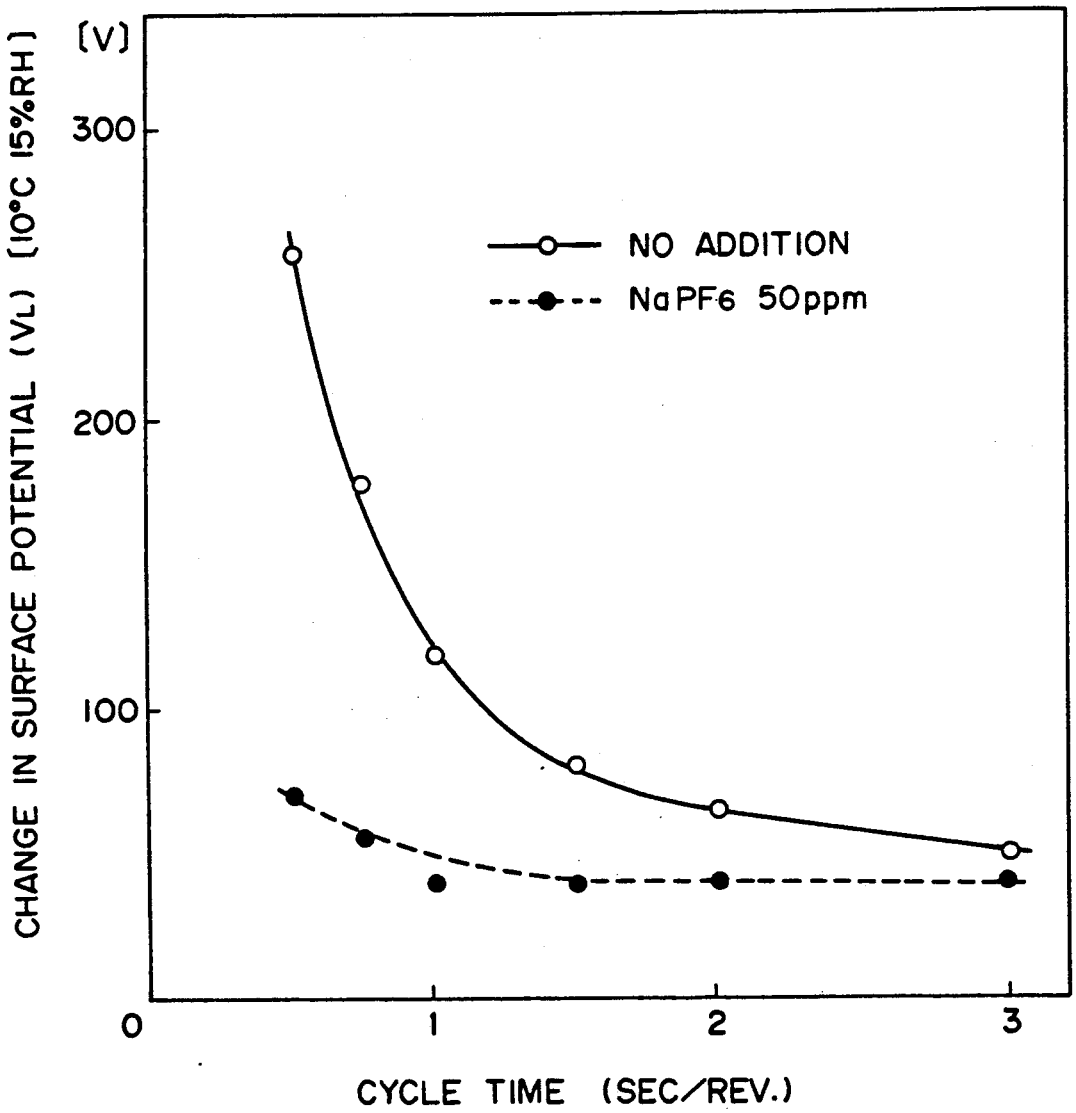
FIG. 8 is a graph showing a relationship between cycle time and surface potential ($V_L$) with respect to Photosensitive Member Examples 82 and 87.

The results obtained in Photosensitive Member Example Nos. 76 and 81 are shown in FIG. 7, and those in Photosensitive Member Example Nos. 82 and 87 are shown in FIG. 8.

As shown in these Figures, the photosensitive member containing no salt provided a larger increase in $V_L$ as the cycle time is shortened. On the contrary, the photosensitive member containing the specific amount of a salt showed a good repetition characteristic even when subjected to a high-speed cycle.

EXAMPLE 8

A polyamide coating material (stock solution (A)) for an intermediate layer was prepared in the same manner as in Example 7.

To the thus prepared coating material, each of salts including lithium nitrate, lithium perchlorate, sodium thiocyanate, sodium borofluoride, potassium chloride, potassium bromide, potassium iodide, calcium nitrate, calcium perchlorate, and ammonium iodide was added so that the resultant salt content was 100 ppm with respect to the weight of the resin component of the above-mentioned coating material (A), whereby coating liquids for intermediate layer for preparing Photosensitive Member Examples No. 94–103 were prepared. Further, the above-mentioned coating material (A) for intermediate layer containing no salt was used as a coating liquid for preparing the intermediate layer of Photosensitive Member Example No. 104.

Separately, a polyurethane coating material (stock solution (B)) for an intermediate layer was prepared in the same manner as in Example 7.

To the thus prepared coating material, each of salts including lithium bromide, lithium chloride, sodium nitrate, potassium thiocyanate, potassium borofluoride, calcium chloride, calcium bromide, calcium iodide, ammonium perchlorate, and ammonium thiocyanate was added so that the resultant salt content was 50 ppm with respect to the weight of the solid content of the above-mentioned coating material (B), whereby coating liquids for intermediate layer for preparing Photosensitive Member Examples No. 105–114 were prepared. Further, the above-mentioned coating material (B) for intermediate layer containing no salt was used as a coating liquid for preparing the intermediate layer of Photosensitive Member Example No. 115.

Separately, a phenolic resin coating material (stock solution (C)) for an intermediate layer was prepared in the same manner as in Example 7.

To the thus prepared coating material (C), each of salts including lithium borofluoride, sodium chloride, sodium bromide, sodium iodide, potassium nitrate, potassium perchlorate, calcium thiocyanate, calcium borofluoride, ammonium bromide and ammonium chloride was added so that the resultant salt content was 150 ppm with respect to the weight of the solid content of the above-mentioned coating material (C), whereby coating liquids for intermediate layer for preparing Photosensitive Member Examples No. 16–125 were prepared. Further, the above-mentioned coating material (C) for intermediate layer containing no salt was used as a coating liquid for preparing the intermediate layer of Photosensitive Member Example No. 126.

Photosensitive Member Example Nos. 94–126 were prepared in the same manner as in Example 7 except that the above-prepared coating liquids were respectively used to form intermediate layers.

With respect to each of the thus prepared Photosensitive Member Examples, a dark part potential characteristic and a light part potential characteristic were evaluated under a low temperature-low humidity (10° C., 15% RH) condition by means of a commercially available electrostatic charging tester (Model: EPA-8100, mfd. by Kawaguchi Denki Seisakusho).

More specifically, the photosensitive member was charged by using corona discharge of −6 KV, and then exposed to halogen light exposure so that light quantity at the photosensitive member surface was 1.5 lux.sec. Such a process including charging and exposure steps was repeated 1000 times. Before and after such repetitive charging and exposure, the surface potential ($V_D$) of the photosensitive member immediately after the charging, and the surface potential ($V_L$) after the exposure of 1.5 lux.sec were respectively measured. The cycle time required for the charging and exposure was 0.75 sec per one revolution.

The results are shown in the following Tables 4 to 6.

TABLE 4

| Photosensitive member | Intermediate layer | Salt added | Initial Stage | | After 1000 revolutions | | Potential change | |
|---|---|---|---|---|---|---|---|---|
| | | | $V_D$(−V) | $V_L$(−V) | $V_D$(−V) | $V_L$(−V) | $\Delta V_D$ | $\Delta V_L$ |
| Example 94 | Polyamide | $LiNO_3$ | 700 | 145 | 700 | 175 | 0 | 30 |
| 95 | | $LiClO_4$ | 705 | 130 | 700 | 175 | −5 | 45 |
| 96 | | NaSCN | 690 | 140 | 690 | 170 | 0 | 30 |
| 97 | | $NaBF_4$ | 700 | 145 | 680 | 180 | −20 | 35 |
| 98 | | KCl | 695 | 165 | 700 | 215 | 5 | 50 |
| 99 | | KBr | 680 | 160 | 685 | 215 | 5 | 55 |
| 100 | | KI | 720 | 170 | 715 | 230 | −5 | 60 |
| 101 | | $Ca(NO_3)_2$ | 700 | 150 | 690 | 190 | −10 | 40 |
| 102 | | $CA(ClO_4)_2$ | 695 | 145 | 695 | 190 | 0 | 45 |
| 103 | | $NH_4I$ | 705 | 150 | 710 | 205 | 5 | 55 |
| Comp. Example 104 | | None | 690 | 150 | 760 | 760 | 70 | 140 |

TABLE 5

| Photosensitive member | Intermediate layer | Salt added | Initial Stage | | After 1000 revolutions | | Potential change | |
|---|---|---|---|---|---|---|---|---|
| | | | $V_D$(−V) | $V_L$(−V) | $V_D$(−V) | $V_L$(−V) | $\Delta V_D$ | $\Delta V_L$ |
| Ex. 105 | Polyurethane | LiBr | 690 | 125 | 700 | 190 | 10 | 65 |
| 106 | | LiCl | 670 | 110 | 680 | 150 | 10 | 40 |
| 107 | | $NaNO_3$ | 675 | 130 | 675 | 180 | 0 | 50 |
| 108 | | KSCN | 705 | 120 | 700 | 165 | −5 | 45 |
| 109 | | $KBF_4$ | 680 | 135 | 725 | 215 | 45 | 80 |
| 110 | | $CaCl_2$ | 690 | 115 | 695 | 155 | 5 | 40 |

TABLE 5-continued

| Photo-sensitive member | Intermediate layer | Salt added | Initial Stage | | After 1000 revolutions | | Potential change | |
|---|---|---|---|---|---|---|---|---|
| | | | $V_D(-V)$ | $V_L(-V)$ | $V_D(-V)$ | $V_L(-V)$ | $\Delta V_D$ | $\Delta V_L$ |
| 111 | | $CaBr_2$ | 720 | 115 | 760 | 190 | 40 | 75 |
| 112 | | $CaI_2$ | 715 | 140 | 750 | 210 | 35 | 70 |
| 113 | | $NH_4ClO_4$ | 700 | 130 | 695 | 190 | −5 | 60 |
| 114 | | $NH_4SCN$ | 720 | 125 | 710 | 170 | −10 | 45 |
| Comp. Ex. 115 | | None | 710 | 130 | 810 | 310 | 100 | 180 |

TABLE 6

| Photo-sensitive member | Intermediate layer | Salt added | Initial Stage | | After 1000 revolutions | | Potential change | |
|---|---|---|---|---|---|---|---|---|
| | | | $V_D(-V)$ | $V_L(-V)$ | $V_D(-V)$ | $V_L(-V)$ | $\Delta V_D$ | $\Delta V_L$ |
| Ex. 116 | Phenolic resin | $LiBF_4$ | 700 | 165 | 745 | 240 | 45 | 75 |
| 117 | | NaCl | 680 | 155 | 705 | 195 | 25 | 40 |
| 118 | | NaBr | 690 | 170 | 720 | 235 | 30 | 65 |
| 119 | | NaI | 705 | 175 | 735 | 245 | 30 | 70 |
| 120 | | $KNO_3$ | 670 | 180 | 690 | 235 | 20 | 55 |
| 121 | | $KClO_4$ | 695 | 185 | 745 | 270 | 50 | 85 |
| 122 | | $Ca(SCN)_2$ | 695 | 160 | 720 | 210 | 25 | 50 |
| 123 | | $Ca(BF_4)_2$ | 705 | 170 | 755 | 250 | 50 | 80 |
| 124 | | $NH_4Br$ | 685 | 175 | 720 | 235 | 35 | 60 |
| 125 | | $NH_4Cl$ | 675 | 160 | 700 | 205 | 25 | 45 |
| Comp. Ex. 126 | | None | 700 | 170 | 855 | 440 | 155 | 270 |

As apparent from the results shown in the above Tables 4–6, the repetition characteristic of a photosensitive member under a low temperature-low humidity condition is remarkably improved by incorporating a specific amount of a salt according to the present invention in the intermediate layer thereof.

Further, with respect to Photosensitive Member Example Nos. 96, 106 and Photosensitive Member Example Nos. 104 and 115, the above-mentioned charging and exposure was successively repeated 1000 times by using the above-mentioned device while the cycle time was changed to 0.5, 0.75, 1.0, 1.5, 2.0 and 3.0 sec per revolution, whereby the change in the surface potential ($V_L$) after the exposure was measured.

Figure 9:
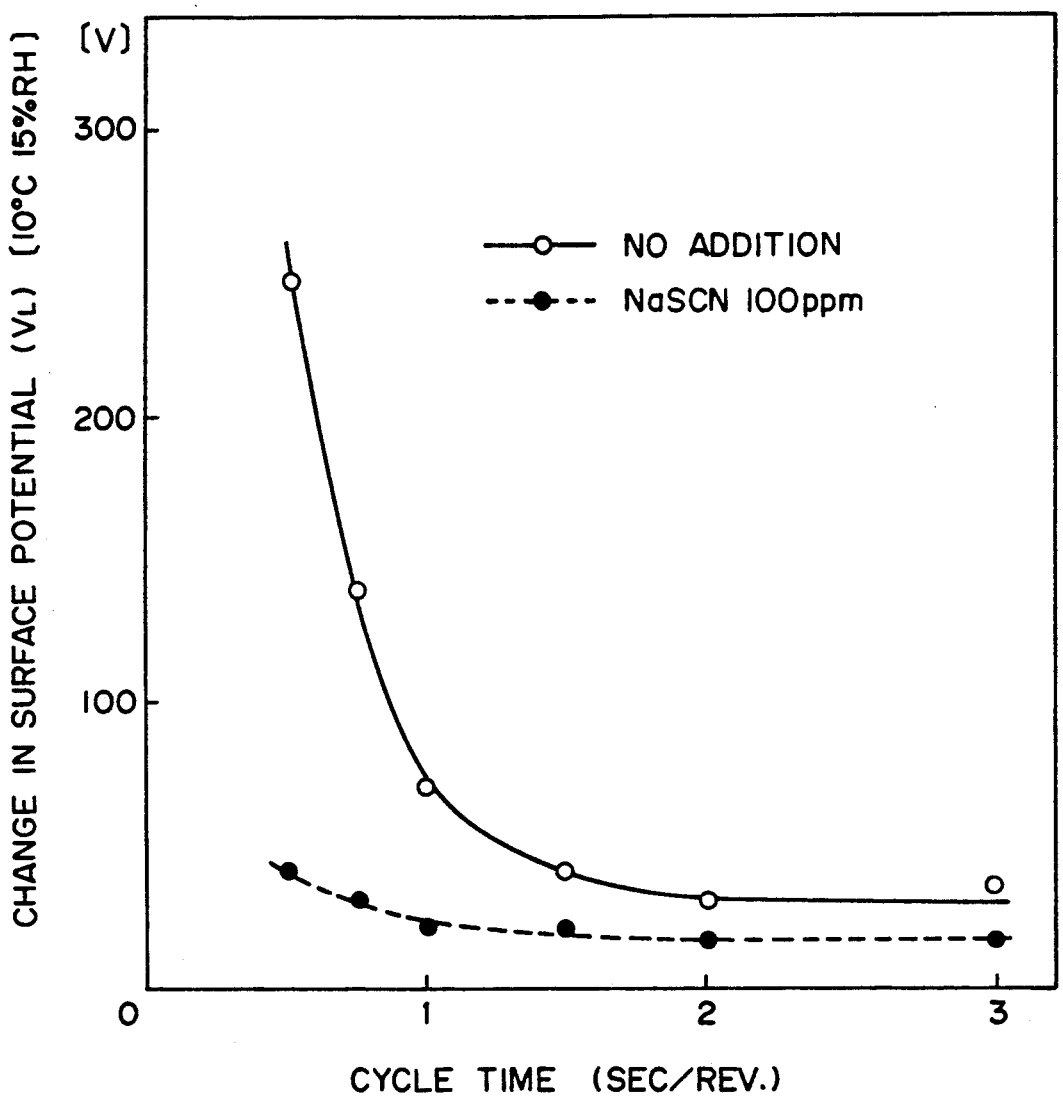
FIG. 9 is a graph showing a relationship between cycle time and surface potential ($V_L$) with respect to Photosensitive Member Examples 96 and 104.
Figure 10:
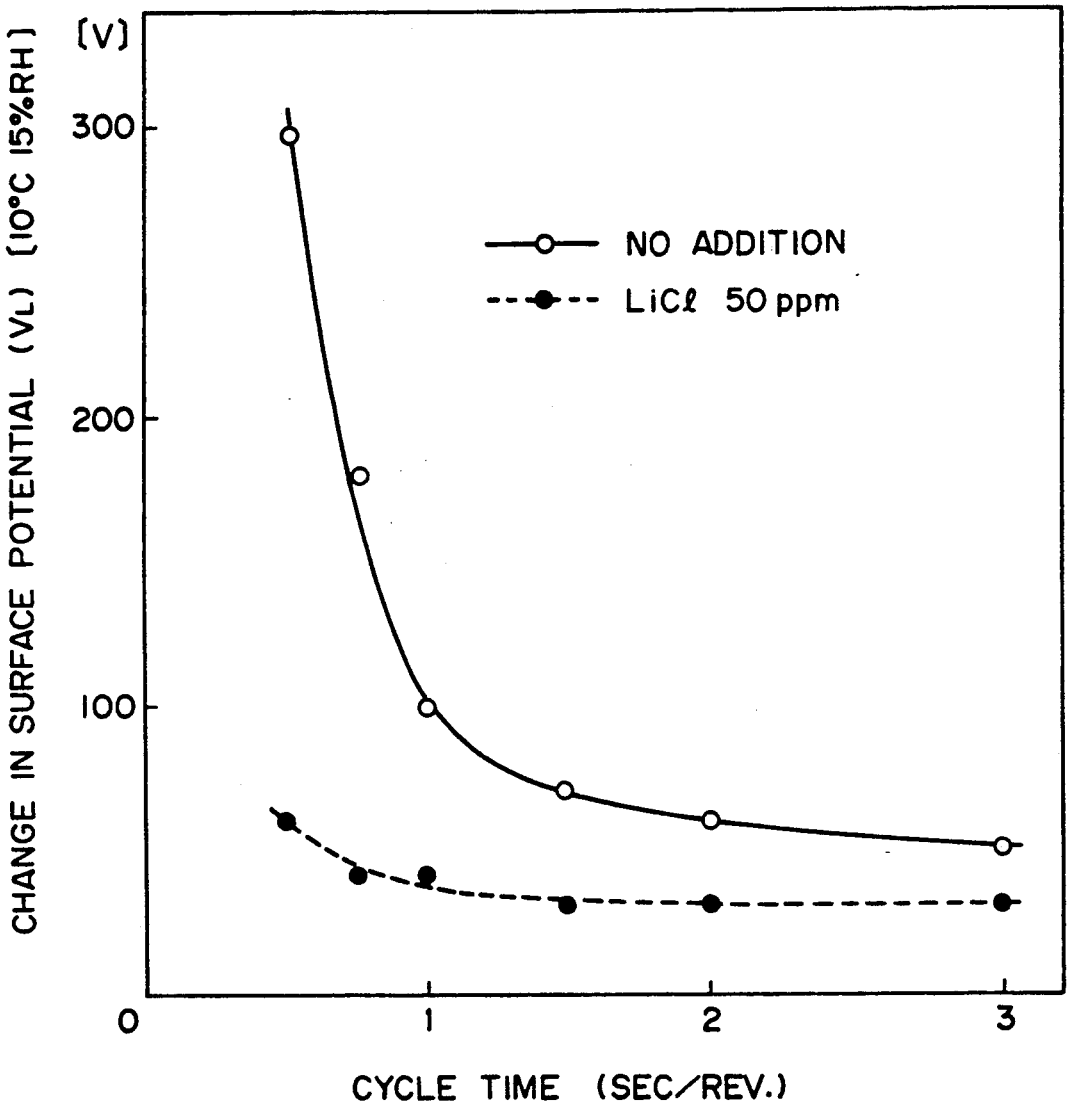
FIG. 10 is a graph showing a relationship between cycle time and surface potential ($V_L$) with respect to Photosensitive Member Examples 106 and 115.

The results obtained in Photosensitive Member Example Nos. 96 and 104 are shown in FIG. 9, and those in Photosensitive Member Example Nos. 106 and 115 are shown in FIG. 10.

As shown in these Figures, the photosensitive member containing no salt provided a larger increase in $V_L$ as the cycle time is shortened. On the contrary, the photosensitive member containing the specific amount of a salt showed a good repetition characteristic even when subjected to a high-speed cycle.

What is claimed is:

1. A photosensitive member for electrophotography comprising: an electroconductive substrate, and an intermediate layer and a photosensitive layer disposed in this order on the substrate; said intermediate layer comprising a resin component and a salt; said intermediate layer containing the salt in an amount of 1–800 ppm based on the weight of the resin component.

2. A photosensitive member according to claim 1, wherein said intermediate layer contains the salt in an amount of 10–800 ppm based on the resin component.

3. A photosensitive member according to claim 1, wherein said salt comprises at least one species selected from the group consisting of perchlorate, borofluoride, thiocyanate, nitrate and halide.

4. A photosensitive member according to claim 1, wherein said salt comprises at least one species selected from the group consisting of carbonate, hydrogencarbonate, thiocarbonate, periodate, hexafluorophosphate, hexafluorosilicate, chlorate and hydroxide.

5. A photosensitive member according to claim 1, wherein said resin component comprises at least one species selected from the group consisting of solvent-soluble polyamide, phenolic resin, polyurethane, and polyester.

6. A photosensitive member according to claim 1, wherein said salt comprises a metal ion as a cationic moiety.

7. A photosensitive member according to claim 6, wherein said metal ion as a cationic moiety comprises at least one species selected from the group consisting of lithium, sodium, potassium, magnesium, calcium, and aluminum.

8. A photosensitive member according to claim 1, wherein said photosensitive layer comprises a single layer.

9. A photosensitive member according to claim 1, wherein said photosensitive layer comprises a laminate comprising an organic charge generation layer and an organic charge transport layer.

10. A photosensitive member according to claim 9, wherein said charge generation layer comprises a charge-generating substance comprising at least one species selected from the group consisting of azo pigment, indigo pigment, and phthalocyanine pigment.

11. A photosensitive member according to claim 9, wherein said charge transport layer comprises a charge-transporting substance comprising at least one species selected from the group consisting of polycyclic aromatic compound, nitrogen-containing cyclic compound, hydrazone compound, and styryl compound.

12. A photosensitive member for electrophotography comprising: an electroconductive substrate, and an intermediate layer and a photosensitive layer disposed in this order on the substrate; said intermediate layer comprising a resin component and an additive which comprises at least one species selected from the group consisting of perchlorate, borofluoride, thiocyanate, nitrate and halide; said intermediate layer containing the additive in an amount of 1–2000 ppm based on the weight of the resin component.

* * * * *

UNITED STATES PATENT AND TRADEMARK OFFICE

CERTIFICATE OF CORRECTION

PATENT NO. : 5,130,216

DATED : July 14, 1992

INVENTOR(S) : TAKASHI KOYAMA, ET AL.

It is certified that error appears in the above-identified patent and that said Letters Patent is hereby corrected as shown below:

COLUMN 3

Line 14, "($\Delta V_L$" should read --($\Delta V_L$)--.
Line 32, "($\Delta V_L$)" should read --($V_L$)--.
Line 58, "n increase" should read --no increase--.

COLUMN 7

Line 9, "as long a" should read --as long as--.

COLUMN 12

Line 60, "100000 ppm," should read --10000 ppm,--.

COLUMN 20

Line 13, "No. 16-125" should read --No. 116-125--.

Signed and Sealed this

Twenty-fifth Day of January, 1994

Bruce Lehman

*Attest:*

BRUCE LEHMAN

*Attesting Officer*

*Commissioner of Patents and Trademarks*